US009398366B2

(12) United States Patent
Gleiβner

(10) Patent No.: US 9,398,366 B2
(45) Date of Patent: Jul. 19, 2016

(54) HANDSET AND HEADSET

(71) Applicant: Sennheiser electronic GmbH & Co. KG, Wedemark (DE)

(72) Inventor: Achim Gleiβner, Barienrode/Diekholzen (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 162 days.

(21) Appl. No.: 13/947,167

(22) Filed: Jul. 22, 2013

(65) Prior Publication Data

US 2014/0185819 A1 Jul. 3, 2014

(30) Foreign Application Priority Data

Jul. 23, 2012 (DE) ..... 10 2012 212 880

(51) Int. Cl.
*H04R 1/10* (2006.01)

(52) U.S. Cl.
CPC ..... *H04R 1/1083* (2013.01); *H04R 2460/01* (2013.01); *H04R 2460/13* (2013.01)

(58) Field of Classification Search
CPC ..... H04R 1/1083; H04R 2460/01; H04R 2460/13; H04R 25/70; H04R 2460/05; H04R 2400/01; A61F 11/08; A61F 2011/085; A61F 2011/145
USPC ..... 381/71.1, 71.6, 74, 23.1, 317, 318, 320, 381/326, 328, 309, 312
See application file for complete search history.

(56) References Cited

U.S. PATENT DOCUMENTS

| | | | | |
|---|---|---|---|---|
| 6,415,034 | B1 | 7/2002 | Hietanen | |
| 7,039,195 | B1 | 5/2006 | Svean et al. | |
| 2009/0016541 | A1 * | 1/2009 | Goldstein | H04R 3/005 381/57 |
| 2010/9061564 | | 3/2010 | Clemow et al. | |
| 2010/0272281 | A1 | 10/2010 | Carreras et al. | |
| 2010/0278352 | A1 | 11/2010 | Petit et al. | |

* cited by examiner

*Primary Examiner* — David Ton
(74) *Attorney, Agent, or Firm* — Frommer Lawrence & Haug LLP

(57) ABSTRACT

Thus there is provided an earphone or headset comprising a housing, an internal microphone, an external microphone and a signal processing unit. The signal processing unit is connected to the internal microphone and the external microphone. The signal processing unit serves for signal processing of an audio signal of the external microphone and for adding the signal-processed audio signal to an audio signal from the internal microphone. The signal processing unit is adapted to perform band pass limitation of the audio signal of the external microphone and to output the added signal as an output signal.

4 Claims, 3 Drawing Sheets

HANDSET AND HEADSET

The present application claims priority from German Patent Application No. DE 10 2012 212 880.8 filed on Jul. 23, 2012, the disclosure of which is incorporated herein by reference in its entirety.

FIELD OF THE INVENTION

The present invention concerns an earphone and a headset.

It is noted that citation or identification of any document in this application is not an admission that such document is available as prior art to the present invention.

Both earphones such as for example in-ear earphones or headphones and also headsets are typically used not only in a quiet environment but also in a noisy environment. That however can severely impair both speech comprehensibility and also audio sensitivity or the quality of reproduction.

U.S. Pat. No. 7,039,195 discloses an ear canal earphone with an internally disposed microphone, an external microphone and an electronic unit coupled to the internal microphone. The electronic unit has an analysis unit for generating a compensation signal for active noise compensation. Active noise compensation is based on the audio signals recorded by the internal or external microphone. A signal from the internal microphone is subjected to signal-dependent filtering to provide good reconstruction of a speech signal. The signal of the internal microphone is analyzed for that purpose and one of the available filters is used, based on that analysis.

In the German patent application from which priority is claimed the German Patent and Trade Mark Office searched the following documents: U.S. Pat. No. 6,415,034 B1, U.S. Pat. No. 7,039,195 B1, US 2010/9061564 A1, US 2010/0272281 A1 and US 2010/0278352 A1.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to provide an earphone and a headset which permits improved speech communication or audio reproduction even in a noisy environment.

Thus there is provided an earphone or a headset comprising a housing and a sealing unit adapted to seal off an ear canal. The earphone or the headset also has an internal microphone for detecting an audio signal produced by bone conduction sound in the ear canal, an external microphone for detecting an audio signal which has an interference sound field and a speech signal transmitted by way of air conduction sound, and a signal processing unit connected to the internal microphone and the external microphone for signal processing of the audio signal detected by the external microphone and for adding the signal-processed signal of the external microphone to an audio signal from the internal microphone. The signal processing unit is adapted to perform band pass filtering or high pass filtering of the audio signal of the external microphone and to output the added signal as an output signal.

In an aspect of the invention the signal processing unit has a band pass for band pass filtering of the audio signal of the external microphone. The transmission range of the band pass is in that case above the frequency spectrum of the audio signal detected at the internal microphone.

In a further aspect of the invention the earphone or the headset has a speech activity detector for passing on the added audio signals of the external microphone and the internal microphone when a speech activity is detected in the audio signal of the internal microphone.

In a further aspect of the invention the earphone or the headset has an operating element, wherein the audio signal recorded by the external microphone is outputted, in particular unfiltered, when the operating element is actuated.

In a further aspect of the invention the earphone or the headset has an opening in the housing to permit pressure equalization between an ear canal and the outside world.

The invention also concerns an earphone or a headset comprising a housing, an internal microphone, an external microphone and a signal processing unit. The signal processing unit is connected to the internal microphone and the external microphone. The signal processing unit serves for signal processing of an audio signal of the external microphone and for adding the signal-processed audio signal (that is to say the signal-processed audio signal of the external microphone) to an audio signal from the internal microphone. The signal processing unit is adapted to perform band pass limitation of the audio signal of the external microphone and to output the added signal as the output signal.

The invention concerns the notion of providing an earphone or a headset having an internal microphone and an external microphone, wherein the audio signals of the external microphone are subjected to band pass limitation and added to the audio signals from the internal microphone. In that way the components of an audio signal, that are not present in the audio signal of the internal microphone, can be supplemented by those components of the audio signal from the external microphone, that are not present in the audio signal of the internal microphone. Thus it is possible to achieve an earphone or a headset with improved speech comprehensibility or with improved comprehensibility of the audio signals.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
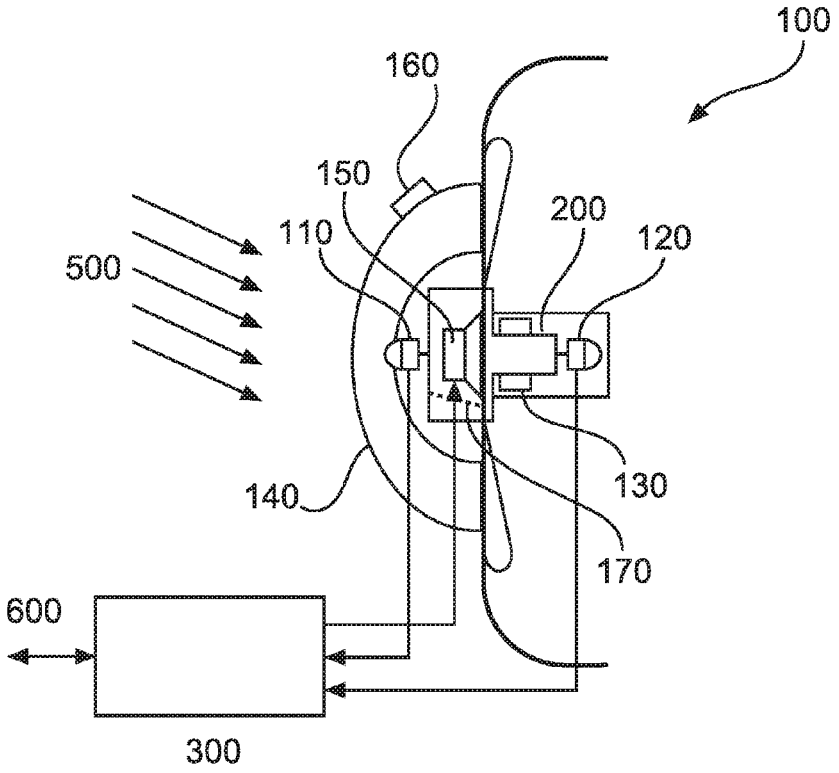
FIG. 1 shows a diagrammatic view of an earphone or a headset according to a first embodiment.

FIG. 1 shows a diagrammatic view of an earphone or headset according to a first embodiment. The earphone or headset 100 has an external microphone 110, an internal microphone 120, a sealing means or a sealing unit 130, optionally an external housing 140, optionally a reproduction transducer 150, optionally an operating element 160 and optionally an opening 170 in the housing 140. The earphone or headset 100 also has a signal processing unit 300 which receives the detected audio signals from the internal microphone 120 and the external microphone 110 and outputs an output signal to the reproduction transducer 150.

Optionally the earphone or headset can have an opening 170 in the housing 140 to provide for pressure equalization between an ear canal 200 of the user and the outside world.

In an aspect of the invention the earphone or headset 100 can be in the form of an in-ear canal earphone or headset so that at least a part of the earphone or headset is introduced into an ear canal 200 of the user. In that case a sealing means 130 can be provided such that the ear canal is at least substantially sealed off when the earphone or headset is at least partially introduced into the ear canal.

The external microphone 110 detects an interference sound field 500. The scaling unit 130 is adapted to acoustically at least partially seal off the ear canal and can be provided for example at the open end of the ear canal 200. Accordingly the internal microphone 120 is disposed in the region which is acoustically sealed off outwardly, in the ear canal 200.

In addition there can optionally be provided an operating element 160 which is adapted to provide a so-called "talk-through" functionality, that is to say the audio signal recorded by the external microphone 110 is passed on to the reproduction transducer. That can be effected for example without further signal processing of the detected audio signal.

Figure 2:
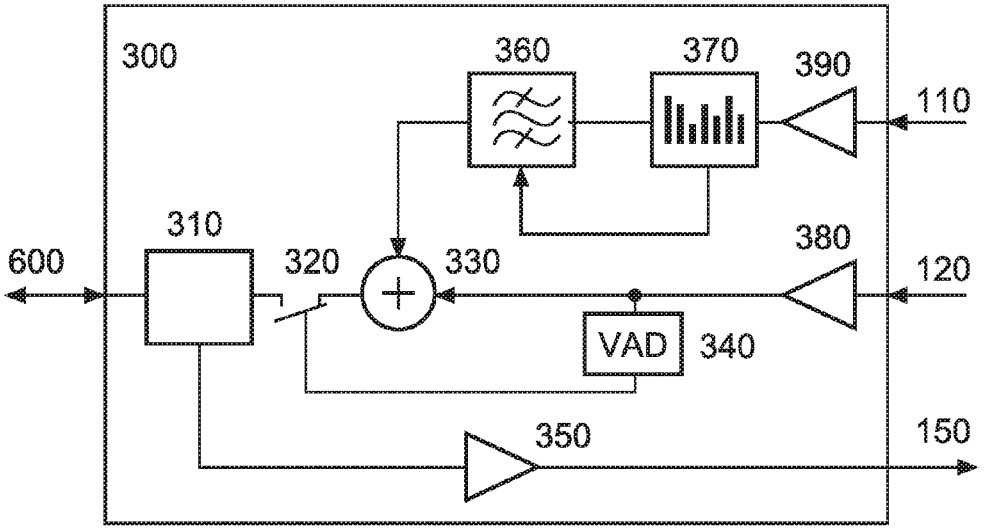
FIG. 2 shows a block circuit diagram of a signal processing unit according to the first embodiment.

FIG. 2 shows a block circuit diagram of a signal processing unit according to the first embodiment. The signal processing unit 300 has an input unit 310, optionally a switch 320, an adding unit 330, optionally a voice activity detector VAD or speech activity detector 340 connected to the switch 320. The signal processing unit further has an amplifier 350 which can be coupled on the one hand to the input unit 310 and on the other hand to a reproduction transducer 150. An internal microphone 120 can be connected to the adding unit 330 by way of an optional amplifier 380. An external microphone 110 can be connected to an optional analysis unit 370 by way of an optional amplifier 390. The analysis unit is in turn connected to a band pass filter 360 and the band pass filter 360 is in turn connected to the adding unit 330.

The adding unit 330 thus serves to add the band pass-filtered audio signal from the external microphone 110 and the audio signal from the internal microphone 120. In that case the audio signal of the external microphone 110 is subjected to audio processing (band pass filtering).

In that respect the signal processing unit 300 is adapted to receive and add both the audio signal of the external microphone 110 and also the audio signal of the internal microphone 120, wherein the audio signals are differently processed. The audio signals detected by the internal microphone 120, by virtue of the arrangement in the ear canal, are already low pass-filtered, that is to say higher frequencies are therefore not detected by the internal microphone 120.

The invention concerns the idea that those frequency components which due to the principle involved cannot be detected by the internal microphone 120 (for example because the internal microphone is disposed in the ear canal region which is acoustically sealed off outwardly) are detected by the external microphone 110 and combined with the signals from the internal microphone 120. In an aspect of the present invention the audio signals of the external microphone 110 are band pass-limited in the band pass filter 360. That is advantageous because it is possible in that way for in particular low-frequency interference components (ambient noise, wind noises) to be reduced or suppressed thereby.

In an aspect of the invention there can be provided the voice activity detector 340 which switches the switch 320 only upon detection of voice activity so that it is only when voice activity occurs that the recorded audio signals of the external and internal microphones 110, 120 are also passed on to the reproduction transducer 150.

Optionally the analysis unit 370 can be provided and can serve to analyze the interference noise field 150 which has been detected by the external microphone 110 and to adapt the band pass unit 360 in accordance with the detected interference sound field 500. In that way for example in a calm and windless environment band pass limitation can be of a different nature than in a noisy and/or windy environment. In a calm and windless environment the transmission curve of the band pass 360 can be suitably selected to be both wider and also higher while in a noisy environment the transmission curve can be of a narrow-band nature and amplitude can be limited.

According to the invention the earphone or the headset can be in the form an in-ear canal earphone or in-ear canal headset. In that case the housing of the earphone or headset together with the sealing means 130 can acoustically seal off the ear canal 200 of an earphone.

The signal processing unit 300 can be provided both in the housing of the earphone and also externally relative to the housing of the earphone or headset. The input unit 310 can be provided as a communication unit for wired or wireless connection to a communication device 600.

According to the invention the transmission range of the band pass filter 360 for the audio signal of the external microphone 110 is selected in a range which is not implemented by the audio signals detected by the internal microphone 120.

In an aspect of the present invention the earphone or headset has two housings each having a respective reproduction transducer so that stereo reproduction and binaural recording is possible.

In a further aspect of the invention the earphone or headset has an active noise compensation unit which uses the audio signal of the internal microphone 120, the audio signal of the external microphone 110 or the sum of those two audio signals for active noise compensation.

The audio signal of the external microphone 110 can be outputted for example on actuation of the operating element 160 in unfiltered form or with reduced filtering to the reproduction transducer 140 in order thus to implement a so-called "talk-through" functionality.

In an aspect of the invention the internal microphone 120 can be used for determining the level in the ear canal so that this can provide for a dosimeter functionality.

In a further aspect of the invention the audio signal recorded by the external microphone 120 is used to reproduce the reproduction of the signal in the reproduction transducer 150 in accordance with the interference level so that this permits interference level-dependent reproduction.

In a further aspect of the invention the housing of the earphone or headset has a through opening 170 to permit pressure equalization between the ear canal 200 and the outside world.

According to the invention the audio signal recorded by the internal microphone 110 is used for communication, wherein that audio signal is improved or adapted by a signal-processed audio signal of the external microphone to provide a naturally sounding audio signal.

Figure 3:
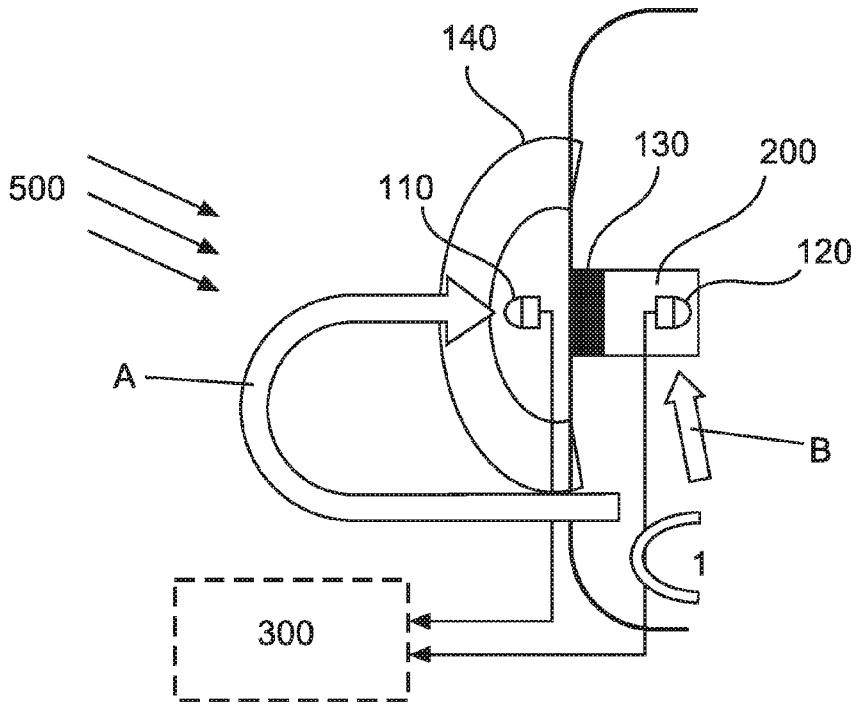
FIG. 3 shows a diagrammatic view of an earphone or a headset according to a second embodiment.

FIG. 3 shows a diagrammatic view of an earphone or headset according to a second embodiment. The earphone or headset of the second embodiment can be based on the earphone or headset of the first embodiment of FIG. 1. The earphone or headset 100 has an external microphone 110, an internal microphone 120, optionally a sealing means 130, optionally an external housing 140 and optionally a reproduction transducer 150. The output signals of the internal and external microphones 120, 110 are passed to a signal processing unit 300.

According to the invention the internal and external microphones 120, 110 are used to detect a speech signal of a wearer. The speech signal of a wearer of the headset or earphone can in this case reach the actual hearing of the wearer, in two different ways. On the one hand a speech signal or the voice of the speaker goes from the vocal tract 1 of the speaker by way of the mouth and the external sound field 500 by way of the pinna and the ear canal 2 to the eardrum of the wearer. On the other hand the speech signal of the speaker goes by way of structure-borne conduction directly to the ear canal 2 which is mechanically stimulated and produces a sound field which in turn passes to the eardrum. A speech signal produced in the vocal tract 1 goes by way of an air conduction sound path A to the external microphone 110 where that speech signal is detected. In addition to the speech signal the external microphone 110 records an interference field 500. That interference field 500 can derive from interference noises and wind turbulence.

By way of the second sound path B, the speech signal goes by way of the bone conduction sound path B to the ear canal 200 and stimulates the wall of the ear canal. The internal microphone 120 can detect the corresponding signal. The sound signal detected by the internal microphone 120 goes only by way of bone conduction sound to the ear canal 200. The ear canal 200 is acoustically sealed off outwardly by the provision of a sealing means or sealing unit 130 at the outer end of the ear canal. That therefore prevents the interference sound 500 or the speech signal A from passing into the ear canal 200 and being detected by the internal microphone 120. Passive damping is achieved by the sealing means or sealing unit 130.

The output signals of the external microphone 110 and the internal microphone 120 can be subjected to signal processing in the signal processing unit 300 and then added.

Figure 4:
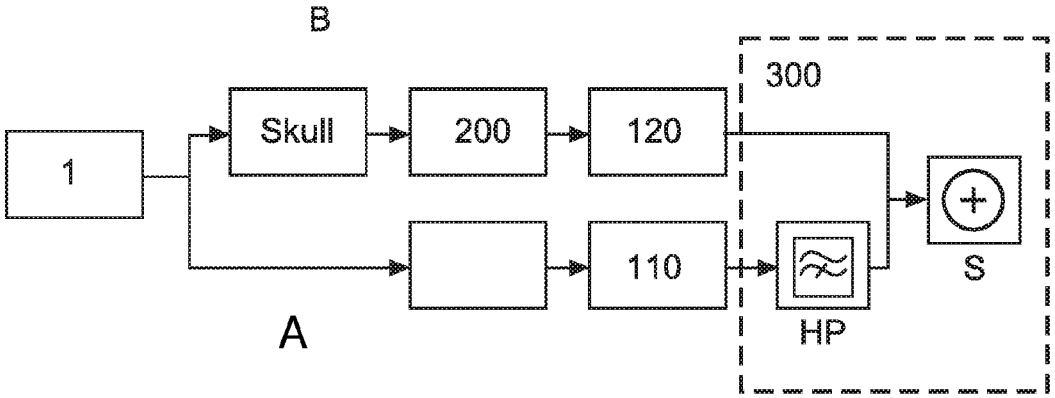
FIG. 4 shows a diagrammatic circuit diagram of an earphone or headset according to a second embodiment.

FIG. 4 shows a schematic block circuit diagram of an in-ear earphone or headset according to a second embodiment. FIG. 4 shows in particular the signal flow of the speech signal by way of the air conduction sound path A and the bone conduction sound path B. In this case a speech signal produced by a vocal tract 1 can pass to the external microphone 110 by way of the air conduction sound path A. The output signal of the external microphone 110 is subjected to high pass filtering in a high pass HP so that wall limitation is effected. The output signal of the high pass filter HP is passed to a summing means S.

By way of the bone conduction sound path B a speech signal produced in the vocal tract 1 passes by way of the skull into the ear canal 200 and is there detected by the internal microphone 120. The output signal of the internal microphone 120 is passed to the summing means S which adds or sums the signals by way of the air conduction sound path A to the signals by way of the bone conduction sound path B.

Optionally the high pass HP and the summing means S can be part of the signal processing unit 300.

According to the invention a speech signal of a speaker is respectively fed to an internal microphone and an external microphone by way of two different sound paths (air conduction sound path A, bone conduction sound path B). The output signals of the internal and external microphones can be differently weighted and then added to produce an overall speech signal.

The internal microphone 120 records the low-frequency components of the speech signal of the wearer as only the sound transmitted by way of the bone conduction sound path B is detected by the internal microphone 120. The interference sound of the interference sound field 500 is detected by the internal microphone 120 only to a slight degree as passive damping can be afforded by the sealing unit 130. The internal microphone 120 serves to detect an air conduction sound signal, produced by the bone conduction sound path B, in the ear canal 200.

In contrast the external microphone 110 records both the interference sound field 500 and also the speech signal by way of the air conduction sound path A. Then high pass filtering is conducted here and the signals of the internal and external microphones are combined.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An earphone or a headset comprising:

a housing;

a sealing unit adapted to seal off an ear canal;

an internal microphone configured to detect an audio signal produced by bone conduction sound in the ear canal;

an external microphone configured to detect an audio signal which has an interference sound field and a speech signal transmitted by way of air conduction sound; and a signal processing unit connected to the internal microphone and the external microphone configured to signal-process an audio signal detected by the external microphone, and to add the signal-processed signal of the external microphone to an audio signal from the internal microphone;

wherein the signal processing unit is adapted to perform band pass filtering or high pass filtering of the audio signal of the external microphone and to output the added signal as an output signal;

wherein the signal processing unit has a band pass for band pass filtering of the external microphone; and wherein the transmission range of the band pass is above the spectrum of the audio signal detected at the internal microphone.

2. The earphone as set forth in claim 1, further comprising:

an operating element;

wherein the audio signal recorded by the external microphone is outputted when the operating element is actuated.

3. The earphone as set forth in claim 1, further comprising:

an opening in the housing configured to equalize pressure between the ear canal and the outside world.

4. An earphone or a headset comprising:

a housing;

a sealing unit adapted to seal off an ear canal;

an internal microphone configured to detect an audio signal produced by bone conduction sound in the ear canal;

an external microphone configured to detect an audio signal which has an interference sound field and a speech signal transmitted by way of air conduction sound;

a signal processing unit connected to the internal microphone and the external microphone configured to signal-process an audio signal detected by the external microphone, and to add the signal-processed signal of the external microphone to an audio signal from the internal microphone; and a speech activity detector configured to pass on the added audio signals of the external microphone and the internal microphone to a communication device when a speech activity is detected in the audio signal of the internal microphone;

wherein the signal processing unit is adapted to perform band pass filtering or high pass filtering of the audio signal of the external microphone and to output the added signal as an output signal.

* * * * *